United States Patent [19]

Herrera

[11] Patent Number: 5,058,474

[45] Date of Patent: Oct. 22, 1991

[54] HEIGHT ADJUSTMENT MEANS FOR BIASING WHEEL

[76] Inventor: Gerardo Herrera, P.O. Box 1202, Tulare, Calif. 93275

[21] Appl. No.: 655,762

[22] Filed: Feb. 14, 1991

[51] Int. Cl.[5] ..... B27B 27/02

[52] U.S. Cl. ..... 83/447; 83/421; 83/425; 83/450; 83/477.2; 144/253 F

[58] Field of Search ..... 83/446, 447, 448, 444, 83/450, 467.1, 468.1, 477.2, 419, 421, 422, 425, 436; 269/303, 233, 238; 144/253 D, 253 F, 253 G

[56] References Cited

U.S. PATENT DOCUMENTS

| | | | |
|---|---|---|---|
| 2,722,247 | 11/1955 | Schroeder et al. | 83/446 |
| 3,738,403 | 6/1973 | Schwoch et al. | 83/446 X |
| 4,026,173 | 5/1977 | Livick | 83/421 |
| 4,452,118 | 6/1984 | Muller | 83/436 X |
| 4,469,318 | 9/1984 | Slavic | 83/447 X |
| 4,499,933 | 2/1985 | Thompson | 83/447 X |
| 4,976,298 | 12/1990 | Gibson | 83/446 X |

*Primary Examiner*—Mark Rosenbaum
*Assistant Examiner*—Eugenia A. Jones
*Attorney, Agent, or Firm*—Dennis B. Haase

[57] ABSTRACT

An improved biasing guide for safely controlling a workpiece disposed on the deck of a machine tool by urging it toward a stationary frame, wherein the height of the elongated arm and bias wheel is easily controlled by a minutely adjustable cam mechanism which is movable against a preset spring tension.

6 Claims, 2 Drawing Sheets

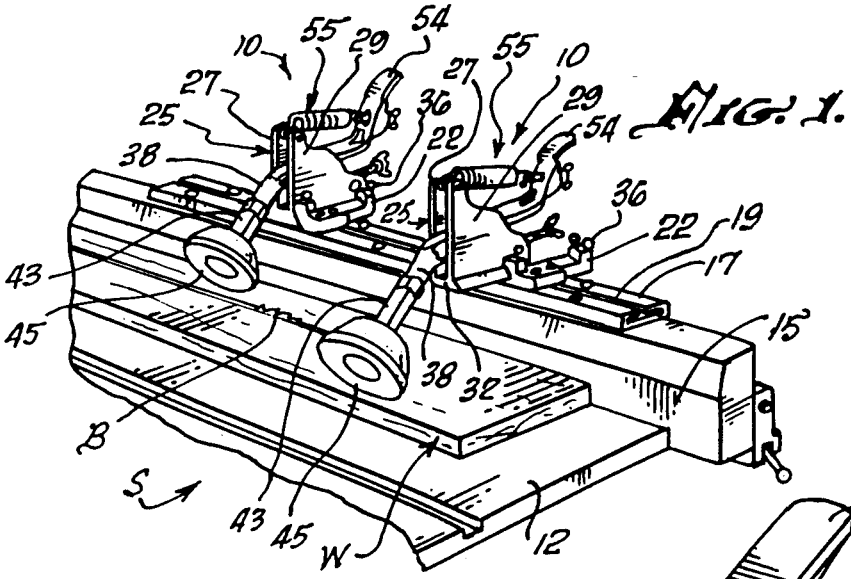
FIG. 1.
FIG. 3.
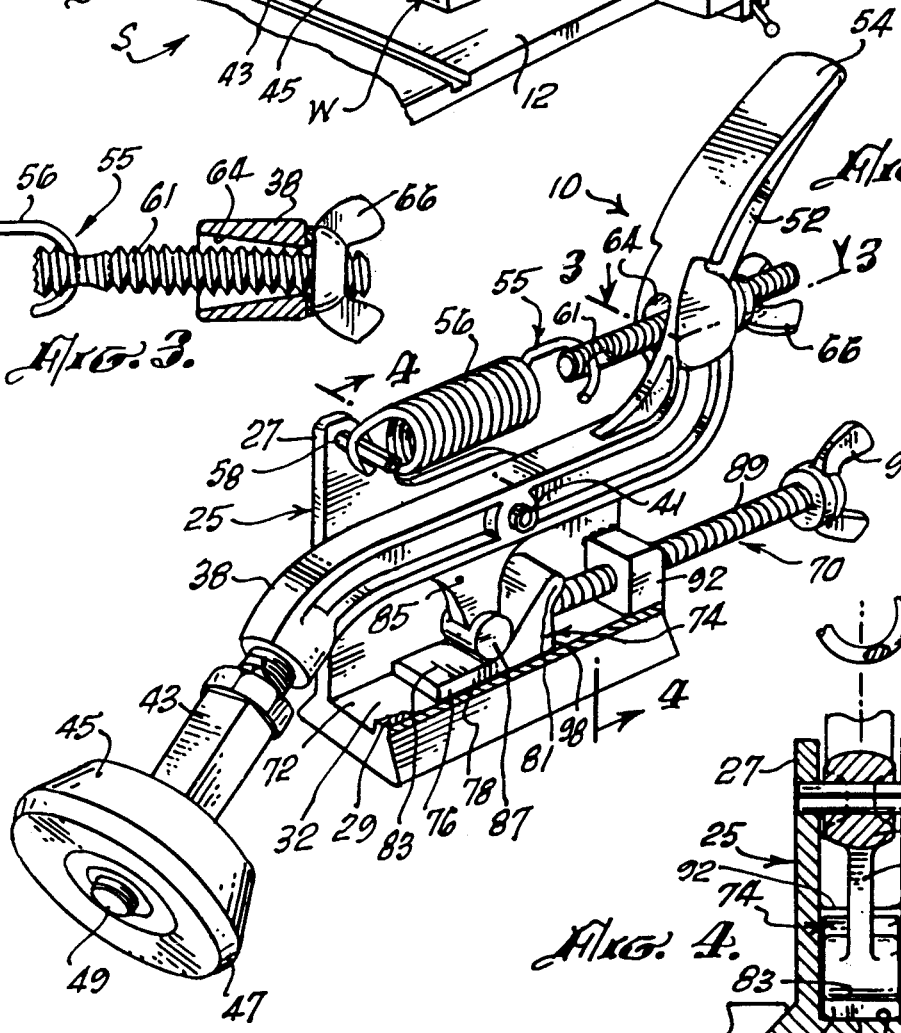
FIG. 2.
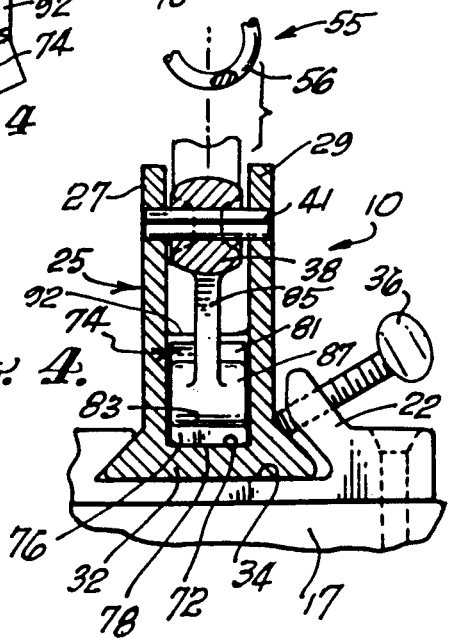
FIG. 4.

HEIGHT ADJUSTMENT MEANS FOR BIASING WHEEL

The present invention relates to means for permitting fine adjustment of a biasing wheel of the type employed in biasing guides for holding a work piece against a fence or guide rail during a sawing or other machine tool operation.

BACKGROUND OF THE INVENTION

1. Field of the Invention

The following specification describes a unique mechanism for permitting fine adjustment of the height of a biasing wheel of a biasing guide of the general type found in Schwoch, et al. U.S. Pat. No. 3,738,403. Such devices are intended to assist in stabilization of a work piece in a machine tool to prevent kickback and other problems related to the operation. Such devices also assist in holding down larger work pieces and materially assist the operator in handling the work piece during operation.

The present invention deals with one aspect of the biasing guide, which has, over the years, proven to be particularly troublesome.

In Schwoch, et al. an initial height adjustment for the biasing roll did not exist. No matter how thick the work piece, the roll would simply be lifted to that height, and the pressure against the work piece would be a function of the spring rate used to provide the downward bias on the shaft. As a consequence, the thicker the work piece, the greater the pressure against it at the point where it was engaged by the biasing roll. As a result, the operator would find that thicker work pieces were far more difficult to manipulate and maneuver, thereby greatly diminishing the value of the bias guide.

2. Overview of Prior Art

Since the issuance of Schwoch, et al. in 1973, there have been several major improvements, and the device has been developed to a high degree of sophistication, and whereas the objectives of the device remain basically the same as those espoused for Schwoch, et al., as a result of many refinements, the most successful present day biasing guide, sold internationally under the trademark "SHOP HELPER", has enjoyed a high degree of acceptability among commercial users, as well as in the home workshop.

Schwoch, et al. was a pioneer in such devices. That patent describes and claims a device which biases or urges a work piece on a radial saw or the like, towards a fence where it holds the piece in place during the sawing operation. The Schwoch apparatus involves the pivoting of a shaft having a biasing wheel at the other end. A spring biases the shaft, and thus the wheel, downward towards the deck or working surface of a machine tool, such as a radial saw. Schwoch suggested, as an alternative to the pivoting shaft, a resilient arcuate shaft having the biasing wheel at one end, and, again, employing a spring to urge the wheel against the working surface of the machine tool.

As the rather primitive Schwoch structure began to evolve, it was found useful to segregate the height and bias pressure functions of the device so that each might be individually controlled. In this manner, one could adjust the height of the bias roll to accommodate various work piece sizes, and then adjust the tension on the roll to achieve the control function while maintaining ease of operation. Several attempts were made at finding ways to adjust the height of the roll initially without unduly complicating the structure, or making it inordinately expensive to manufacture. One such effort involved the drilling of several holes in the side walls along the leading edge, and by use of a pin extending between the walls, the height was pre-adjusted. Such a configuration was limited, however by the spacing of the holes. Other efforts were equally deficient.

SUMMARY OF THE PRESENT INVENTION

The present invention seeks to resolve the difficulties experienced in prior devices with setting and establishing the initial height of the bias wheel.

To this end, it is an objective of the present invention to provide a mechanism for accomplishing initial height adjustment of the biasing wheel in such a manner that very fine adjustments may be accomplished even while working on non-standard board thicknesses.

It is a further objective of the present invention to accomplish the foregoing in a manner which is highly simplified and inexpensive both in use and construction, and, as such, even the most clumsy novice may accomplish the pre-height adjustment, and thereafter establish the proper biasing tension on the wheel.

As will be described hereinafter in detail, these objectives are accomplished by camming the floating mechanism upon which the biasing wheel is mounted into the desired initial height position.

DESCRIPTION OF THE DRAWINGS

Having outlined the environment in which the present invention was conceived and in which its utility is best found, a detailed description of the preferred embodiment will be hereinafter presented in conjunction with the accompanying drawings;

FIG. 1 is a pictorial representation of the environment in which the present invention has great utility:

FIG. 2 is a partially sectioned cut away view of the mechanism of the present invention;

FIG. 3 is a partial sectional view of a portion of the mechanism of FIG. 2, taken along lines 3—3 thereof;

FIG. 4 is a partial sectional view of a portion of the mechanism of FIG. 2, taken along lines 3—3 thereof;

DESCRIPTION OF A PREFERRED EMBODIMENT

Figure 5:
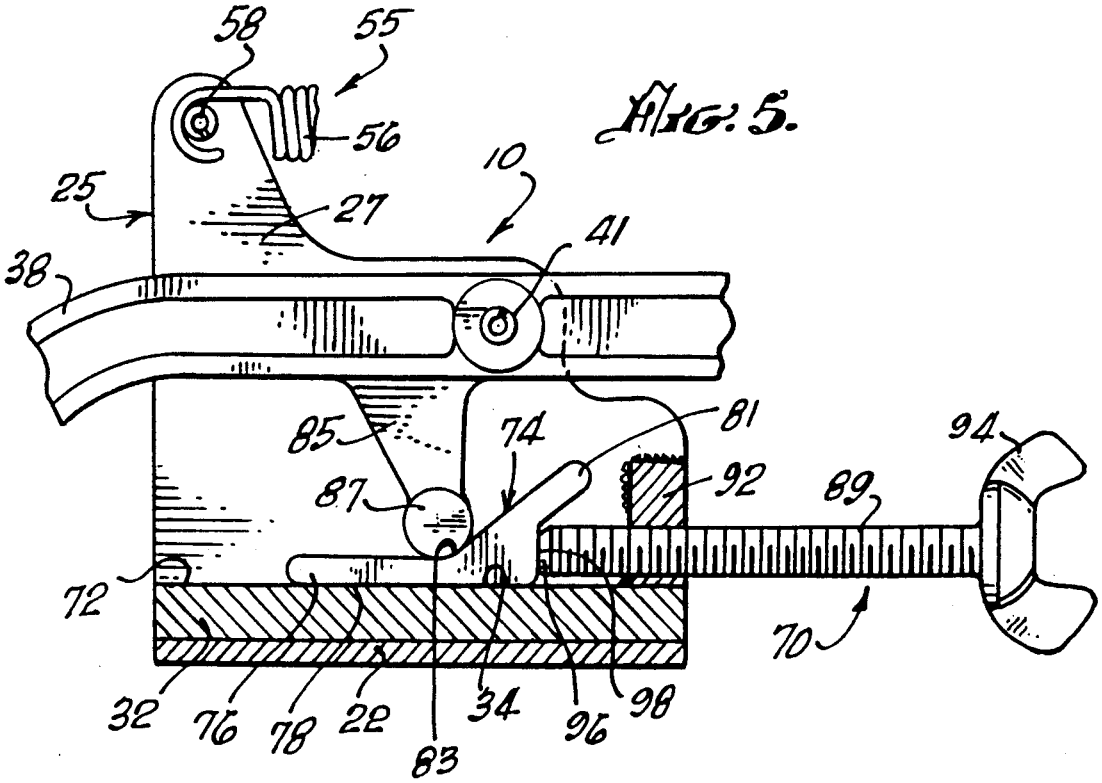
FIG. 5 is a partial sectional view of the mechanism of FIG. 2 illustrating the mechanism in its "at rest" position.

With reference to the drawings, and initially to FIG. 1, work piece biasing apparatus 10 is illustrated in connection with a saw S having a deck or working surface 12. A work piece W reposes on the deck 12 and is slideable against a fence or rail 15 longitudinally along the deck 12 in the path of the rotating saw blade B which, in this particular instance, cuts the board to a pre-determined width. While the environment described is a table saw, it will be appreciated that any number of machine tools may be operated with greater ease and safety by using the guide of the present invention.

The biasing devices 10, (typically used in pairs) are mounted to be moveable both longitudinally, and transversely, to pre-determined positions fore and aft so that they might be disposed on either side of the saw blade to the longitudinal axis of the work piece. To this end, a rail 17 is mounted to the fence 15, and provides a track 19 into which a holding device 22 is mounted for longitudinal movement. Each work piece biasing device 10 is mounted in a holding device 22 so that its position may be adjusted fore and aft or towards and away from the fence 15.

With particular reference to FIGS. 1 and 4, each work piece biasing device 10 comprises a housing 25 defined by two upstanding parallel side walls 27 and 29, respectively, integrally formed with a dovetailed base 32 which rides in a track 34 of the holding device 22, which is held in position by a thumb screw 36.

Disposed between the side walls 27 and 29 is a flanged, or channeled, shank or arm 38. The shank is mounted between the side walls 27 and 29 on a pin 41, about which it is rotatable.

At the forward end of the shank is an adjustable post 43 to which is mounted a biasing wheel 45, having a beveled leading edge 47, which is adapted to contact the work piece W, as seen in FIG. 1. The wheel 45 is mounted for rotation about a hub 49, and, where desirable, a one-way sprague type clutch of known construction may be employed between the hub, or wheel, to limit the rotation of the wheel 45 to one direction.

At the end of the flanged shank, remote from the wheel 45, is a handle portion 52 having a flat 54 formed thereon to permit manual manipulation of the wheel 45 where desired.

In order to maintain a desired tension of the wheel 45 on the work piece W, a tensioning mechanism 55, best seen in FIGS. 2 and 3, is employed and comprises a spring 56, anchored by an anchor pin 58, to the sidewalls 27 and 29, respectively. The free end of the spring is engaged by a threaded stud 61, which passes through an opening 64, formed in the handle 54, where it receives a wing nut 66. It will be readily seen that rotation of the wing nut will adjust the tension of the spring, and the pulling action of the spring translates into a downward pressure of the beveled surface 47 on the work piece W.

While proper tension on the work piece is essential to permit the work piece to be manipulated on the deck 12 against the fence 15, it is extremely difficult to obtain the necessary pressure unless an initial adjustment is made in the height of the biasing wheel 45. Since a work piece may be any height, it is important to the effective operation of the work piece biasing device 10 that initial fine adjustment of the height be possible. To this end, and in keeping with the objectives earlier articulated, the present invention provides a unique, yet exceedingly simple, device for "camming" the shank 38, and thus the wheel 45, upwardly, from an at rest position as illustrated in FIG. 5, to a desired initial height as a preliminary to adjusting the tension with the tensioning mechanism 55.

Figure 6:
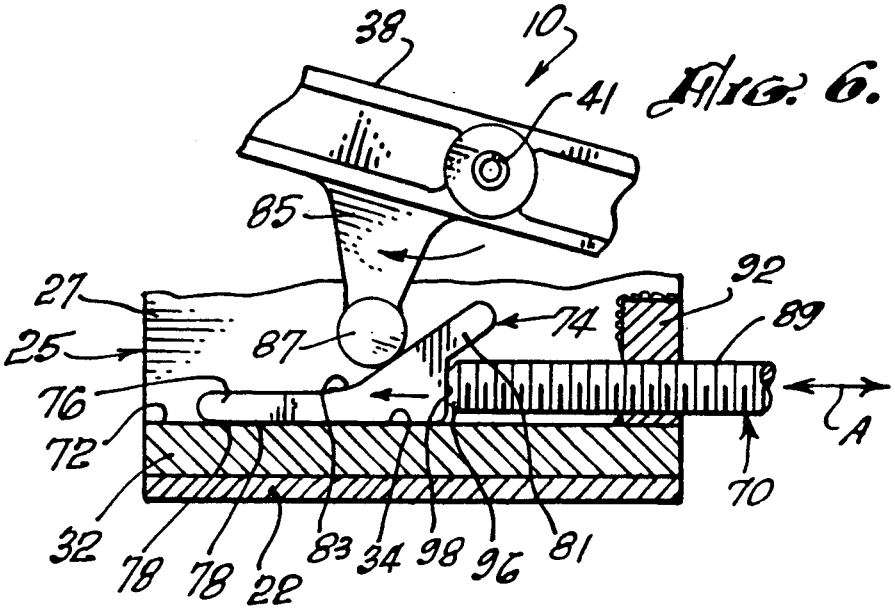
FIG. 6 is a view such as that of FIG. 5, illustrating the mechanism in a partially elevated position.
Figure 7:
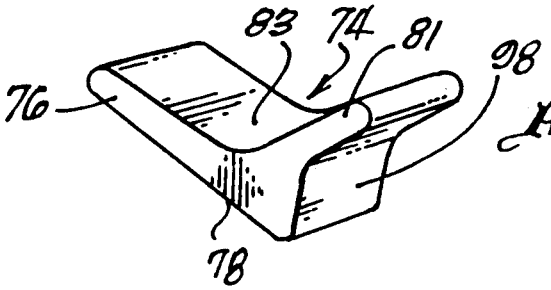
FIG. 7 is a perspective of the camming device of the present invention.

With particular reference to FIGS. 2, 5 and 6, the initial height adjustment mechanism 70 is illustrated in considerable detail. Specifically, a slide, or track, 72 is formed between the side walls 27 and 29 on the interior surface of the dovetail base 32. A cam plate 74, illustrated best in FIG. 7, includes a base portion 76, the bottom surface 78 of which reposes in, and is adapted to, slide fore and aft of the housing on the track 72. A cam 81 is intergrally formed with, and rises from, the base or foot portion 76, and a smooth camming surface 83 is formed on the upper surface of the foot and merges with the upper surface of the cam 81. A smooth transition between the two surfaces is provided.

The flanged shank 38 is formed with a depending cam follower 85, which terminates in a cylindrical portion 87, the surface 88 of which is smooth and hardened for engagement with the camming surface 83. As seen in FIGS. 5 and 6, the cam follower 85 is disposed forward of the pivot pin 41 upon which the shank is rotatably mounted, i.e., it is toward the end of the shank which carries the wheel 45.

In order to move the cam 74, a stud 89 is threadably received in a threaded block 92, and wing nut 94, or other suitable device is secured at the end of the stud 89 projecting beyond the housing. The forward end of the stud 96 engages a vertical wall 98 formed at the rear of the cam 74, and rotation of the wing nut 94 will result in longitudinal movement of the stud 89 in the direction of arrow A which will result in the movement of cam 74 along the track 72. This will result, as seen in FIG. 6, in the clockwise rotation of the shank 38 around the pin 41 with the result that the wheel 45 will be raised. Because of the fineness of the threads on the stud 89, fine adjustment may be accomplished.

Once the initial height of wheel 45 is adjusted with respect to the work piece, tensioning mechanism, as best seen in FIG. 3, is adjusted to provide the proper pressure on the work piece to permit safe and efficient operation of the work piece biasing device.

Having described the preferred embodiment of the invention, what is claimed is:

1. An improved biasing guide for safely controlling a work piece disposed on a deck of a machine tool by urging it toward a stationary fence, said biasing guide including a bias wheel disposed at one end of an elongated arm:

a housing having parallel vertical walls, and including means for pivotally mounting said elongated arm between the walls intermediate the ends of said arm;

means for adjusting the initial height of the bias wheel to conform to the height of the work piece, said adjustment means comprising a cam disposed in the housing so as to be movable fore and aft along a path between said parallel vertical walls: said cam having a camming surface thereon:

a cam follower disposed intermediate the bias wheel and said pivot means, and depending from said elongated arm so as to be in the path of said cam for contact with said camming surface; and means connected to said cam and protruding from said housing for moving said cam fore and aft such that said cam follower is moved by said camming surface in an arc about said pivot means thereby adjusting the initial height of said bias wheel.

2. The biasing guide as set forth in claim 1, wherein said parallel vertical sidewalls are joined by a base member: the upper surface of said base member defining a track for reciprocally receiving and guiding said cam.

3. The biasing guide as set forth in claim 2, wherein said cam includes an upwardly extending back member and said cam is movable in said track by means of a screw which engages said cam back member to push said cam.

4. The biasing guide as set forth in claim 3, wherein spring means is provided to bias said cam back member against said screw.

5. The biasing guide as set forth in claim 4, wherein the tension on said spring is manually adjustable.

6. The biasing guide as set forth in claim 1, wherein said cam follower terminates in a cylindrical portion in sliding engagement with said cam.

* * * * *